US009068434B1

(12) United States Patent
Phillips et al.

(10) Patent No.: US 9,068,434 B1
(45) **Date of Patent: *Jun. 30, 2015**

(54) INTERCONNECTING END CAPS FOR AN OIL FIELD MAT SYSTEM

(71) Applicant: HB GREEN RESOURCES, LLC, Lafayette, LA (US)

(72) Inventors: Mark Leon Phillips, Lafayette, LA (US); Kenneth Ray Boersma, Wadsworth, OH (US)

(73) Assignee: HB GREEN RESOURCES, LLC, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/505,424

(22) Filed: Oct. 2, 2014

Related U.S. Application Data

(63) Continuation-in-part of application No. 13/909,923, filed on Jun. 4, 2013.

(60) Provisional application No. 61/655,344, filed on Jun. 4, 2012.

(51) Int. Cl.

| | |
|---|---|
| ***E01C 5/22*** | (2006.01) |
| ***E21B 41/00*** | (2006.01) |
| ***E01C 9/08*** | (2006.01) |

(52) U.S. Cl.
CPC ..... *E21B 41/0021* (2013.01); *E01C 5/22* (2013.01); *E01C 9/086* (2013.01); *E01C 2201/14* (2013.01)

(58) Field of Classification Search
CPC .... E21B 41/0021; E01C 5/18; E01C 2201/16
USPC ..... 404/44, 46, 19, 20, 34–38; 52/392, 574, 52/581, 588.1, 591.4, 591.1
See application file for complete search history.

(56) References Cited

U.S. PATENT DOCUMENTS

| | | | | |
|---|---|---|---|---|
| 1,828,193 | A * | 10/1931 | Levin | 52/388 |
| 4,462,712 | A * | 7/1984 | Penland, Sr. | 404/36 |
| 4,600,336 | A * | 7/1986 | Waller, Jr. | 404/35 |
| 4,875,800 | A * | 10/1989 | Hicks | 404/35 |
| 4,973,193 | A * | 11/1990 | Watson et al. | 404/35 |
| 5,032,037 | A * | 7/1991 | Phillips et al. | 404/73 |
| 5,316,408 | A * | 5/1994 | Stanley et al. | 404/35 |
| 5,595,037 | A * | 1/1997 | Paques | 52/578 |
| 5,822,944 | A * | 10/1998 | Penland, Sr. | 52/591.1 |
| 6,380,309 | B1 | 4/2002 | Parker et al. | |
| 6,474,905 | B1 * | 11/2002 | Smith et al. | 404/35 |
| 6,862,857 | B2 * | 3/2005 | Tychsen | 52/582.1 |
| 6,945,732 | B2 * | 9/2005 | Renick | 404/35 |
| 7,413,374 | B2 * | 8/2008 | Rogers et al. | 404/35 |
| 7,500,336 | B2 * | 3/2009 | McGivern et al. | 52/650.3 |

(Continued)

FOREIGN PATENT DOCUMENTS

| | | | | |
|---|---|---|---|---|
| JP | 01239202 | A * | 9/1989 | E01C 9/08 |

*Primary Examiner* — Thomas B Will
*Assistant Examiner* — Jessica H Lutz
(74) *Attorney, Agent, or Firm* — Buskop Law Group, PC; Wendy Buskop

(57) ABSTRACT

An end cap assembly for interlocking with an oil field mat usable to support trucks, equipment and personnel around a drilling rig. The end cap assembly having an elongated base layer, a base layer coupler, a top layer, a middle layer, a plurality of holes, a plurality of fasteners and a plurality of coupler fasteners. Each coupler fastener can be disposed through the holes in the board of the end cap assembly to form a base layer coupler to create a tri-layer oil field mat.

26 Claims, 13 Drawing Sheets

(56) References Cited

U.S. PATENT DOCUMENTS

| | | | | |
|---|---|---|---|---|
| 7,985,475 | B2 | 7/2011 | Dubrow | |
| 8,291,661 | B2 * | 10/2012 | Bengry et al. | 52/392 |
| 8,375,673 | B2 * | 2/2013 | Evjen | 52/592.1 |
| 8,784,001 | B1 * | 7/2014 | Phillips et al. | 404/35 |
| 2002/0110418 | A1 * | 8/2002 | Renick | 404/35 |
| 2010/0275541 | A1 * | 11/2010 | Prinz | 52/302.1 |
| 2010/0313510 | A1 * | 12/2010 | Tang | 52/403.1 |
| 2012/0124925 | A1 * | 5/2012 | Prinz et al. | 52/302.1 |
| 2012/0304566 | A1 * | 12/2012 | Thrush et al. | 52/302.1 |

* cited by examiner

INTERCONNECTING END CAPS FOR AN OIL FIELD MAT SYSTEM

CROSS REFERENCE TO RELATED APPLICATION

The current application is a Continuation in Part of co-pending U.S. patent application Ser. No. 13/909,923 filed on Jun. 4, 2013, entitled "METHOD FOR MAKING AN OIL FIELD MAT," which claims priority to and the benefit of Provisional Patent Application Ser. No. 61/655,344 filed on Jun. 4, 2012, entitled "METHOD FOR MAKING AN OIL FIELD MAT". These references are hereby incorporated in their entirety.

FIELD

The present embodiments generally relate to an end cap assembly for a tri-layer oil field support mat usable to support trucks, equipment, and personnel around a drilling rig.

BACKGROUND

A need exists for an end cap assembly usable with oil field mats that is synthetic, easy to install, easy to remove, highly durable mat and can withstand extreme temperatures for use around oil field equipment.

A need exists for oil field mat end caps that do not absorb oil field contaminants.

A further need exists for oil field mat end caps that are safer for personnel, and which maintains the original mat shape regardless of torque applied to the mat and end cap combination, weight applied to the mat and end cap combination or movement applied to the mat and end cap combination.

A need exists for oil field mat end caps with a slip resistant surface.

A need exists for oil field mat end caps that are pinless and have a simplistic assembly.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to end caps for a tri-layer oil field support mat end cap usable to support trucks, equipment, and personnel around a derrick, or a Christmas tree.

The present embodiments further relate to end cap assemblies for oil field mats that are made from a plurality of synthetic boards.

The end caps can have pigment added, such as yellow to make oil field mat end caps safer for personnel at night. A combination of yellow and black pigment in boards of the end caps enable personnel to avoid tripping as they work on the oil field mat.

The combination yellow and black pigment in the oil field end caps works in the dark, in the headlights of forklifts, will catch the yellow and prevent the forklift driver from running off the oil field mat.

The end caps protect rig containment material which stops toxic spills and provide a clear definitive end point for the oil field mat system.

The end caps save fossil fuels because recycled hydrocarbon materials are used to make the oil field mats. The end caps have a small carbon footprint because they do not require cutting down trees or the use of lumber made from wood.

The end caps effectively prevent fires and explosions at the rig site because they provide a clear end to the mats, so that trucks and heavy equipment used at the rig site do not run over gas lines or connected well equipment.

The end caps prevent trip hazards and stops workers from having broken bones by maintaining the original mat shape regardless of torque applied to the end cap, weight applied to the end cap or movement applied to the end cap.

The term "oil field mat" can refer to a half mat or a full mat.

Figure 1:
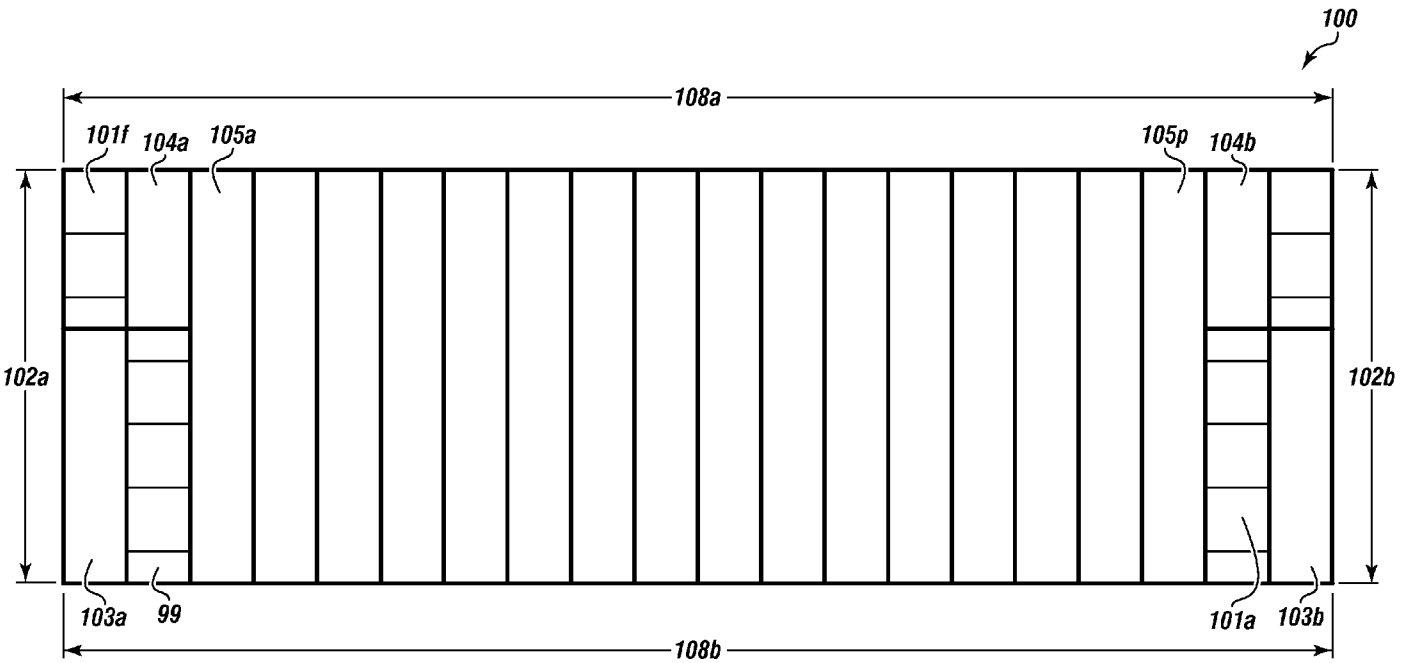
FIG. 1 is a top view of a half mat usable to connect two full mats together according to one or more embodiments.

Turning now to the Figures, FIG. 1 is a top view of a half mat usable to connect two full mats together according to one or more embodiments. The end cap assembly can connect to the full and half mat combination.

A half mat 100 is shown with half mat base boards 101*a*-101*f*, which can be mounted in parallel. In one or more embodiments, the half mat base can include about 6.5 boards. The half mat base can include the half mat base boards 101*a*-101*f* and a half mat half bottom board 99.

A pair of half mat longitudinal movement control boards 103*a* and 103*b* can be attached to the half mat base boards 101*a*-101*f* at an orientation at a right angle to the orientation of the half mat base boards and aligned with an edge of each short side 102*a* and 102*b* of the half mat base.

A pair of half mat lateral movement control boards 104*a* and 104*b* can be mounted to be flush with the long sides 108*a* and 108*b* of the half mat base. The half mat lateral movement control boards 104*a* and 104*b* can extend 2.5 board widths across the half mat base boards of the half mat base at a right angle to the orientation of the half mat base boards of the half mat base.

At least two and up to seventeen cross ties 105*a*-105*p*, which can be oriented at a 90 degree angle to the orientation of the half mat base boards 101*a*-101*f* and half mat half bottom board 99, wherein the first of the cross ties is affixed to the half mat base boards at least two cross tie board width in from each short side of the half mat base.

In an embodiment, from about 3 to about 7 cross ties can be in the row of cross ties, in an alternating manner to the cross ties to provide a light weight oil field mat assembly, which is easier and cheaper for transport.

Figure 2A:
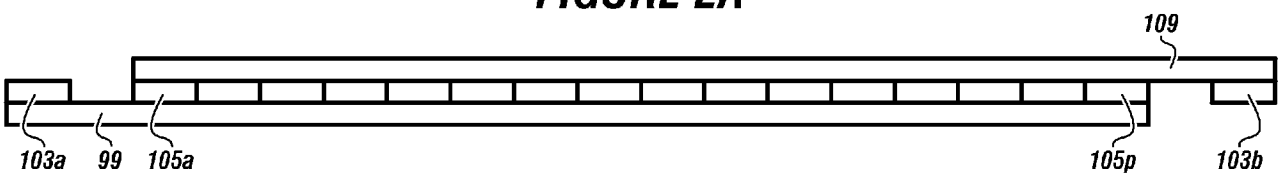
FIG. 2A is a side view of an assembled half mat with top layer according to one or more embodiments.

FIG. 2A is a side view of an assembled half mat with top layer according to one or more embodiments.

In one or more embodiments, the half mat can have a half mat half bottom board 99 over which can be mounted on one edge one of the half mat longitudinal movement control board 103*a*. On an opposite side can be another half mat longitudinal movement control board 103*b*. A board width vacancy can be formed between each of the half mat longitudinal movement control boards 103*a* and 103*b* and a plurality of cross ties 105*a*-105*p* which can be mounted at a right angle to the half mat half bottom board 99.

A one half width top layer parallel board 109 is also shown.

Figure 2B:
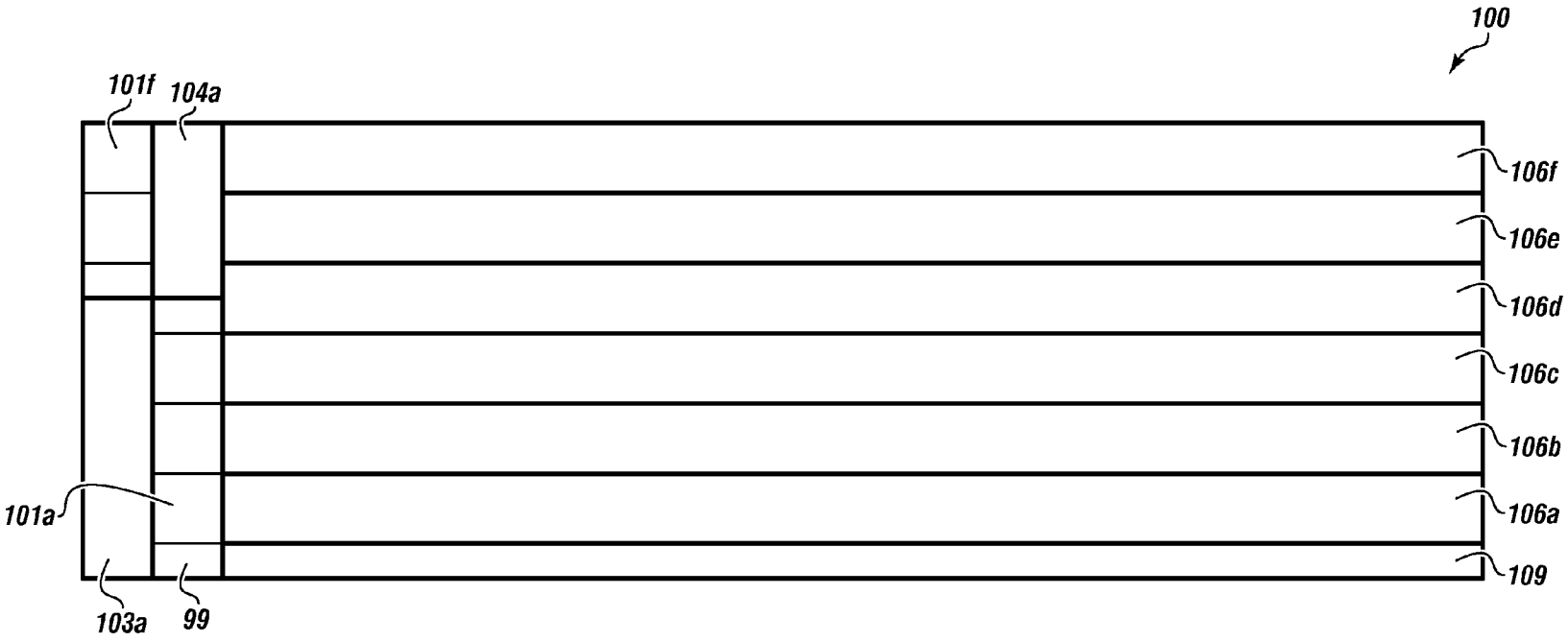
FIG. 2B is a top view of the assembled half mat.

FIG. 2B is a top view of the assembled half mat.

In one or more embodiments, the top layer for the half mat 100 can be formed from top layer parallel boards 106*a*-106*f* and one half width top layer board 109.

The top layer parallel boards 106*a*-106*f* can be attached at a right angle to the plurality of cross tie and parallel with the half mat base boards 101*a*-101*f* and the half mat half bottom board 99.

The half mat longitudinal movement control board 103*a* and the half mat lateral movement control board 104*a* are also shown.

The base layer stops two board widths, such as about 15 inches to about 17 inches, forming an interlock opening. Longitudinal movement control boards can affix to the top layer, but not the bottom layer or the cross ties. The cross ties can connect to all of the top layer and all of the bottom layer. The longitudinal movement control boards can attach to the base layer.

Figure 3:
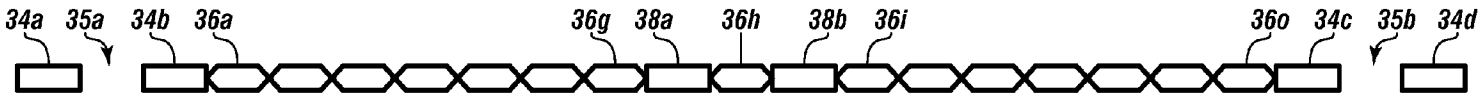
FIG. 3 shows the middle layer of an embodiment of the oil field mat assembly.

FIG. 3 shows the middle layer of an embodiment of the oil field mat assembly. The middle layer can be used to create a top layer, middle layer or bottom layer in end cap assemblies.

In this embodiment, the middle layer can have middle layer beveled boards 36*a*-36*o* and two spacer boards 38*a* and 38*b*, which can be disposed strategically between the middle layer beveled boards. The spacer boards can be square or rectangular.

Beveled boards can be used to create a top layer, middle layer or bottom layer in end cap assemblies. The beveled boards can all be used on a top layer, or a combination of square edge boards and beveled boards can be used. In other embodiments, only square edge boards can be used in all three layers of the end cap assembly.

In this embodiment, the middle layer can have a second square edged board 34*b* adjacent middle layer beveled boards 36*a*-36*g*, which can be adjacent the first spacer board 38*a*. An eighth middle layer beveled board 36*h* can be adjacent the first spacer board 38*a*.

A second spacer board 38*b* can be adjacent the middle layer beveled board 36*h* and middle layer beveled boards 36*i*-36*o*, which can be connected in parallel. Middle layer beveled board 36*o* can adjoin the third square edged board 34*c*.

A board width size vacancy 35*a* can be provided between the first square edged board 34*a* and the second square edged board 34*b*. On the opposite end, a board width size vacancy 35*b* can be provided between the third square edged board 34*c* and the fourth square edged board 34*d*.

In an embodiment, the boards can be connected together using fasteners. Fasteners can be bolts and can be used per board through the top layer, through the middle layer, to the bottom layer to fasten the three layers together. The fasteners can be used to connect the layers of the end cap assembly in a manner identical to the fasteners used to connect layers of an oil field mat together.

Figure 4:
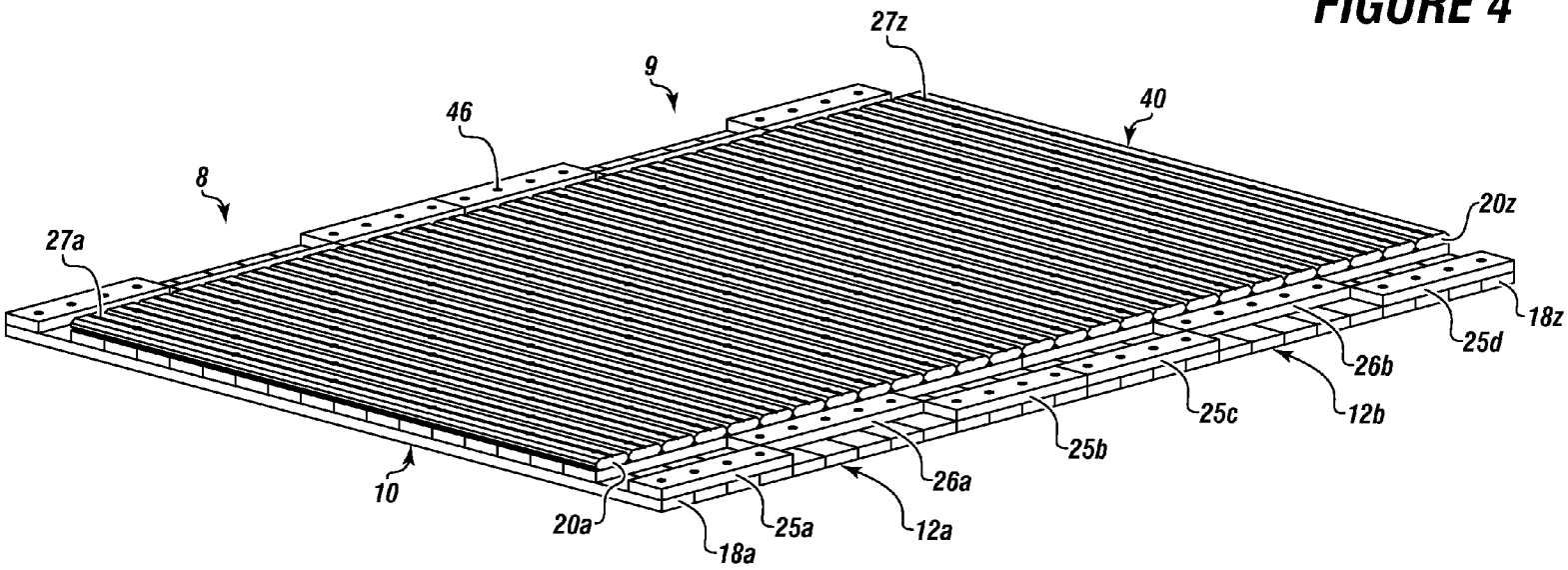
FIG. 4 depicts two oil field mats, each with an interlock assembly formed in the bottom layers.

FIG. 4 depicts two oil field mats 8 and 9, each with an interlock assembly formed in the bottom layers.

Each oil field mat is formed with bottom layer boards 18*a*-18*z* forming a bottom layer 10 on a first side 12*a* of oil field mat 8 and a first side 12*b* of oil field mat 9.

Two aligned locking members 25*a* and 25*b* are attached to the bottom layer 10 of oil field mat 8 and aligned with the edge of the first side 12*a* to provide longitudinal movement control.

Two aligned locking members 25*c* and 25*d* are attached to the bottom layer 10 of oil field mat 9 and aligned with the edge of the first side 12*b* to provide longitudinal movement control.

A first offset locking member 26*a* can be disposed between the two aligned locking members 25*a* and 25*b* and positioned apart from the edge of the first side 12*a*.

A second offset locking member 26*b* can be disposed between the two aligned locking members 25*c* and 25*d* and positioned apart from the edge of the first side 12*b*.

Also shown is the top layer 40 with top beveled boards 20*a*-20*z*. In one or more embodiments, the top beveled boards can each have a groove 27*a*-27*z*.

Fasteners 46 are also shown for holding the offset locking members and the aligned locking members.

Figure 5:
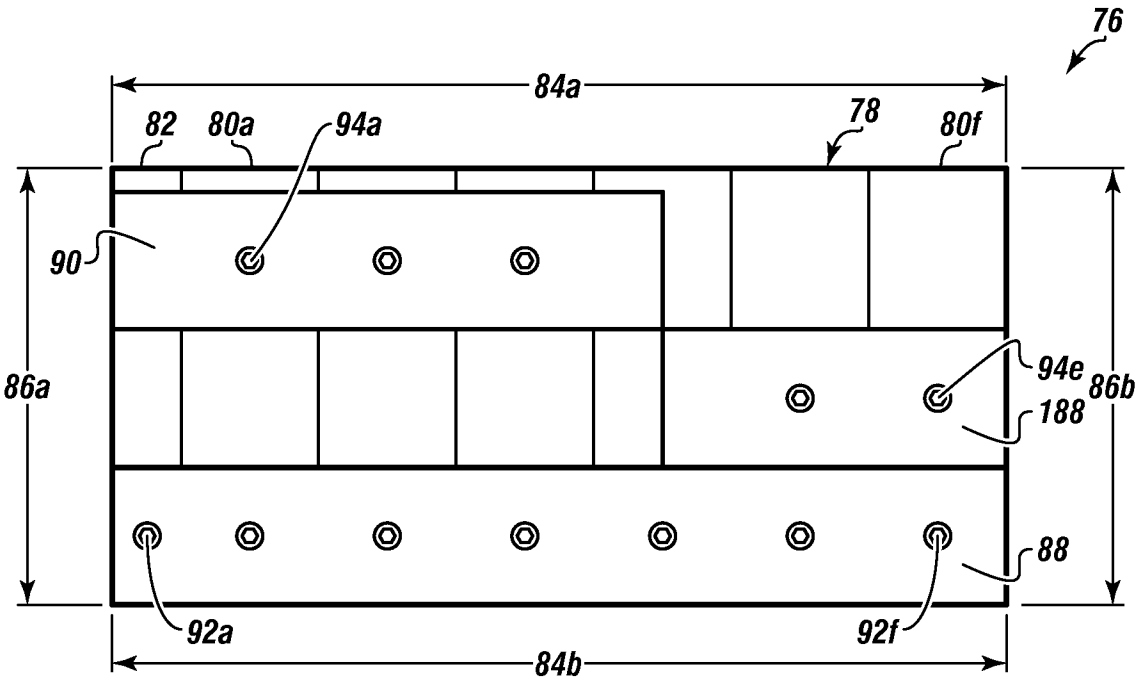
FIG. 5 shows one of the half end cap configurations used with two connected oil field mats forming the oil field mat assembly.

FIG. 5 shows one of the half end cap configurations used with two connected oil field mats forming the oil field mat assembly.

In other embodiments, two half end caps and one full end cap can be used on the side of the pair of oil field mats.

In one or more embodiments, the end caps can engage the interlock assemblies of the bottom layer.

The half end cap 76 can be formed from end cap beveled boards 80*a*-80*f* and a half end cap board 82. In one or more embodiments, six end cap beveled boards and a half end cap board can be used.

The end cap beveled boards 80*a*-80*f* can be positioned in parallel with each other. The assembled parallel end cap beveled boards form an end cap top 78 with a pair of end cap long sides 84*a* and 84*b* and a pair of end cap short sides 86*a* and 86*b*.

An end cap longitudinal movement control board 88 can be mounted to the top layer of parallel boards at an orientation at a right angle to the orientation of the top layer parallel boards.

The end cap longitudinal movement control board 88 can be a stack of two of the end cap beveled boards mounted on top of each other and fastened to the top layer of parallel boards.

The end cap longitudinal movement control board 88 serves to prevent and longitudinal movement of each oil field mat of the oil field mat assembly by connecting with the interlock assembly of the bottom layer of the oil field mat.

The end cap longitudinal movement control board 88 can be aligned with one of the end cap long sides 84*a* and both end cap short sides 86*a* and 86*b* of the end cap top 78.

An end cap lateral movement control board 90 can be mounted to the end cap beveled boards that form the end cap top 78 in parallel with but spaced apart from the end cap straight edge locking board 188 and at a right angle to the orientation of the beveled parallel boards that form the end cap top.

The end cap lateral movement control board 90 can be mounted adjacent the end cap long side 84*b* opposite the end cap straight edge locking board 188 for preventing longitudinal movement of the oil field mat connected to the end cap.

A plurality of end cap fasteners 92*a*-92*f* can connect the end cap lateral movement control board, the end cap longitudinal movement control board, and the end cap straight edge locking board 188 to the end cap beveled boards of the end cap top.

A plurality of end cap connectors 94*a*-94*e* can also be used to enable the half end cap to maintain a preset shape and facilitate the maintenance of a preset shape for each oil field mat connected thereto.

The end cap beveled boards 80*a*-80*f* and the half end cap board 82 can be in parallel but offset from the end cap beveled boards connected in parallel forming the top layer of the oil field mat.

The end cap lateral movement control board 90 of the half end cap 76 can engage between the two aligned locking members of the interlock edge on the bottom layer of the oil field mat.

The end cap longitudinal movement control board 88 can lock between the interlock edge of the bottom layer of the oil field mat and the offset locking member.

Figure 6:
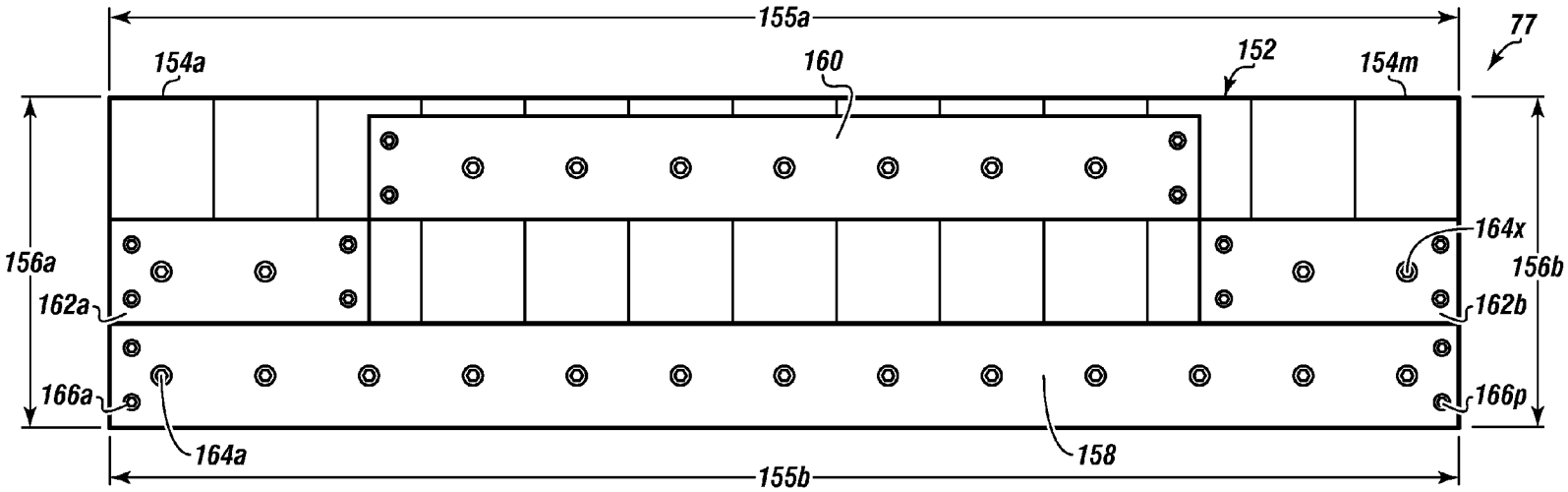
FIG. 6 is a top view of a full end cap usable with the interlock assembly of each oil field mat already described.

FIG. 6 is a top view of a full end cap usable with the interlock assembly of each oil field mat already described.

The full end cap 77 can be made from full end cap beveled boards 154*a*-154*m* mounted in parallel. In one or more embodiments the full end cap can be made from thirteen end cap beveled boards.

The full end cap beveled boards can form a full end cap top 152 with a pair of full end cap long sides 155*a* and 155*b*, which can be about 96 inches long, and a pair of full end cap short sides 156*a* and 156*b*, which can be about 23 inches long.

A full end cap locking board 158, which can be formed from two stacked boards and can be straight edged or beveled edged, can be mounted to the full end cap top 152 to prevent longitudinal movement of the oil field mats engaged with the top.

The full end cap locking board 158 can be aligned with one of the full end cap long sides 155*a* and with both full end cap short sides 156*a* and 156*b* of the full end cap top 152.

A full end cap longitudinal movement control board 160 can be mounted to the full end cap top 152 in parallel proximate to the full end cap long side 155*a*. In an embodiment the full end cap longitudinal movement control board 160 can be flush mounted to the full end cap long side 155*a*.

The full end cap longitudinal movement control board 160 can prevent longitudinal movement on the pair of oil field mats to which the full end cap is attached.

The full end cap top also includes a pair of full end cap lateral movement control boards 162*a* and 162*b*.

Each full end cap lateral movement control board 162*a* and 162*b* can be mounted to the full end cap top 152 in parallel with the full end cap locking board 158 and at right angles to the full end cap beveled boards 154*a*-154*m*.

In an embodiment, each full end cap lateral movement control board 162*a* and 162*b* can be mounted flush with one of the full end cap short sides 156*a* or 156*b* of the full end cap top 152 proximate to the full end cap locking board 158.

A plurality of full end cap fasteners 164*a*-164*x* can connect the full end cap lateral and longitudinal movement control boards, which include the full end cap locking board 158, to the full end cap beveled boards of the full end cap top. The full end cap fasteners can be bolts.

A plurality of full end cap connectors 166*a*-166*p*, which can be screws, can connect between full end cap beveled boards and the full end cap top to maintain a preset shape of the end cap top and to maintain a preset shape for each oil field mat.

The full end cap lateral movement control boards 162*a* and 162*b* of the full end cap top 152 can engage between the two aligned locking members of the interlock assemblies of the oil field mats, and the full end cap longitudinal movement control board 160 can lock between the interlock assemblies and the offset locking members of each oil field mat.

Figure 7A:
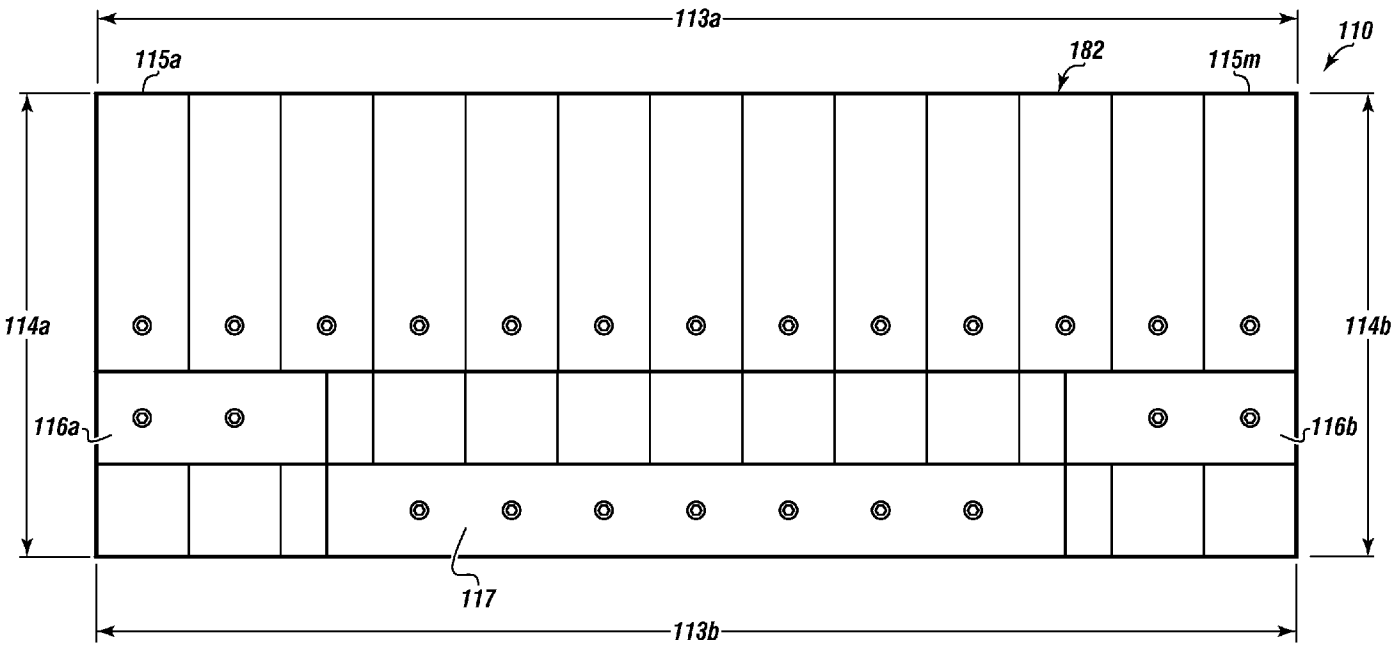
FIG. 7A depicts a top view of a safety end cap.
Figure 7B:
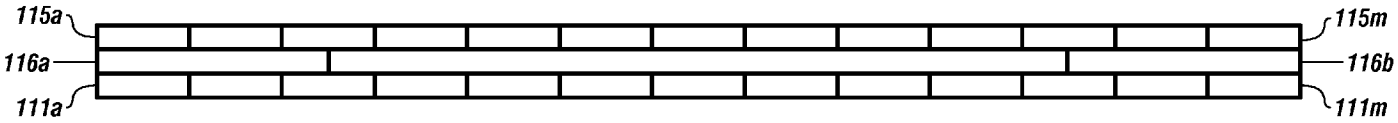
FIG. 7B depicts a side view of the safety end cap.
Figure 7C:
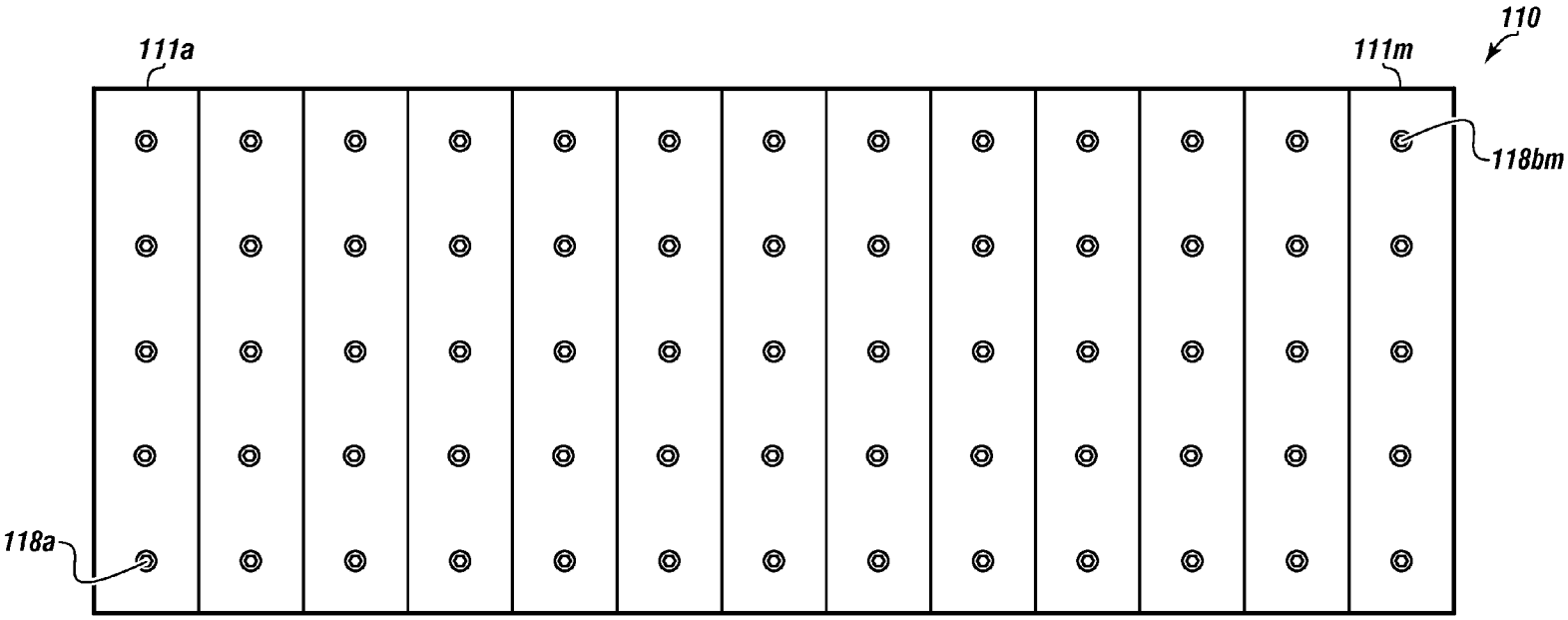
FIG. 7C depicts a bottom view of the safety end cap.

FIG. 7A depicts a top view of a safety end cap. FIG. 7B depicts a side view of the safety end cap. FIG. 7C depicts a bottom view of the safety end cap.

Referring to FIGS. 7A-7C, the safety end cap 110 can include a safety end cap top 182. Parallel safety beveled boards can form a pair of safety long sides 113*a* and 113*b* and a pair of safety short sides 114*a* and 114*b*. In one or more embodiments, thirteen parallel safety beveled boards can be used.

Middle safety boards, which are not shown in these Figures, can be positioned to the bottom side of the safety end cap 110 and in between and perpendicular to the parallel safety beveled boards 111*a* and 111*m* and a plurality of safety top boards 115*a* and 115*m*.

In an embodiment, yellow pigment can be added to create seven yellow top boards and six black top boards in an alternating pattern.

A pair of safety lateral movement control boards 116*a* and 116*b* wherein one of the safety lateral movement control boards 116*a* and 116*b* can be flush with one of the safety shorts sides 114*a* and 114*b* and at an orientation at a right angle to the parallel safety beveled boards 111*a* and 111*m*.

A safety longitudinal movement control board 117 can be flush with the safety long side 113*b* and at a right angle to the parallel safety beveled boards 111*a* and 111*m*.

Safety fasteners 118*a* and 118*bm* can be used to connect the boards of the safety end cap 110 together.

Figure 8:
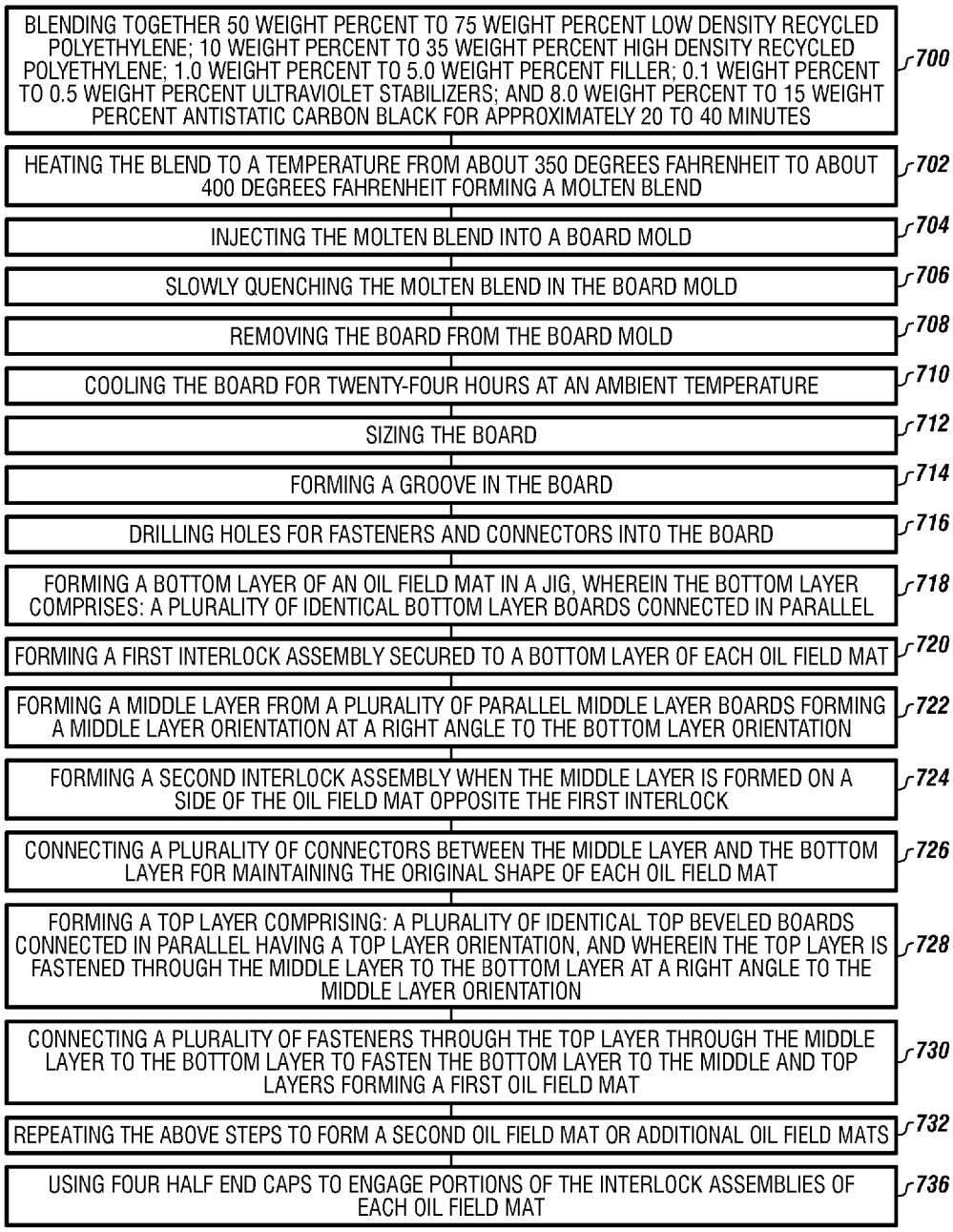
FIG. 8 depicts the method for making an oil field mat from a plurality of synthetic boards.

FIG. 8 depicts the method for making an oil field mat from a plurality of synthetic boards.

The method can include blending together 50 weight percent to 75 weight percent low density recycled polyethylene; 10 weight percent to 35 weight percent high density recycled polyethylene; 1.0 weight percent to 5.0 weight percent filler; 0.1 weight percent to 0.5 weight percent ultraviolet stabilizers; and 8.0 weight percent to 15 weight percent antistatic carbon black for approximately 20 to 40 minutes, as shown in step 700.

The method can include heating the blend to a temperature from about 350 degrees Fahrenheit to about 400 degrees Fahrenheit forming a molten blend, as shown in step 702.

The blend can be placed into an extruder at heated at a temperature which is above the melting point of the polyethylene component.

The method can include injecting the molten blend into a board mold, as shown in step 704.

The method can include slowly quenching the molten blend in the board mold, as shown in step 706. The slow quenching of the molten blend in the board mold can be done in water to cool.

The method can include removing the board from the board mold, as shown in step 708.

The method can include cooling the board for twenty-four hours at an ambient temperature, as shown in step 710. The cooling can be longer or shorter depending on ambient temperature.

The method can include sizing the board, as shown in step 712; and can include forming a groove in the board, as shown in step 714.

The board can be cut to a desired length depending upon application and the groves can be centrally formed in the top of the boards, such as with a router groove. The groove can be from about 1/16 of an inch to about 1/8 of an inch deep and from about 1/4 of an inch to about 3/8 of an inch in width.

The method can include drilling holes for fasteners and connectors into the board, as shown in step 716.

The method can further involve forming a bottom layer of an oil field mat in a jig, wherein the bottom layer comprises: a plurality of identical bottom layer boards connected in parallel, as shown in step 718.

The method can include forming a first interlock assembly secured to a bottom layer of each oil field mat, as shown in step 720.

In one or more embodiments, the bottom layer holes can be formed to receive a nut, wherein the nut can be pressed into the bottom layer holes. In another embodiment, a nut can be used for receiving the ends of the fasteners, which can be installed from the top layer.

In one or more embodiments, the bottom layer can be formed using parallel identical boards, and then pins can be placed in the drilled holes to facilitate alignment of the additional layers of boards.

The method can further include forming a middle layer from a plurality of parallel middle layer boards forming a middle layer orientation at a right angle to the bottom layer orientation, as shown in step 722.

The method can include forming a second interlock assembly when the middle layer is formed on a side of the oil field mat opposite the first interlock, as shown in step 724.

The method can include connecting a plurality of connectors between the middle layer and the bottom layer for maintaining the original shape of each oil field mat, as shown in step 726.

In one or more embodiments, the middle boards can be laid at a 90 degree angle to an orientation of the bottom boards and positioned so the pins of the bottom boards can pass through the middle boards. The first and a second interlock assembly are created, one for engagement with the bottom layer, and one for engagement with the top layer.

Connectors can be installed between the middle boards and the bottom boards to ensure retaining of original full mat shape, original half mat shape, or original end cap shape. In an embodiment, the connectors can be screwed in with a power screwdriver or similar power tool.

The method can include forming a top layer comprising: a plurality of identical top beveled boards connected in parallel having a top layer orientation, and wherein the top layer is fastened through the middle layer to the bottom layer at a right angle to the middle layer orientation, as shown in step 728.

The method can include connecting a plurality of fasteners through the top layer through the middle layer to the bottom layer to fasten the bottom layer to the middle and top layers forming a first oil field mat, as shown in step 730.

In one or more embodiments, the top layer can be installed over the pins at an orientation identical to the bottom boards and at a 90 degree angle to the orientation of the middle boards. One pin at a time can then be removed and fasteners, such as bolts can be installed in the holes to connect the three layers together.

The method can further include repeating the above steps to form a second oil field mat or additional oil field mats, as shown in step 732.

The method can also include using four half end caps to engage portions of the interlock assemblies of each oil field mat, as shown in step 736.

In an embodiment, the half safety caps can be one half the size of a full safety end cap and can use one half the number of boards.

In an embodiment, the oil field mat assembly can include four oil field mats with two 8 foot full end caps and four 4 foot half end caps per two oil field mat assemblies.

In an embodiment, the end cap assembly can have boards with bevels on each longitudinal side of the beveled boards for a total of four bevels per board.

In an embodiment, the end cap assembly can have boards, each with a central groove disposed on the top side of the top beveled boards, which can be for safety and to reduce slipping.

In an embodiment, each end cap can be formed from boards of recycled polyethylene with yellow pigment.

The end cap assembly in an embodiment can have from about 3 fasteners to about 20 fasteners installed through each top layer boards, through the middle layer boards, and to the bottom layer boards per oil field mat.

In an embodiment, the end cap assembly can use from about 13 fasteners to about 247 fasteners installed through top layer boards, through the middle layer boards, and to the bottom layer boards per oil field mat.

In an embodiment, the end cap assembly can use from about 6 fasteners to about 28 fasteners installed through each board to form each full or half end cap.

In an embodiment, the top layer, middle layer, and base layer can be connected to each other by a plurality of fasteners, the plurality of fasteners comprising a screw, a bolt, a nail, an epoxy, or combinations thereof.

In an embodiment, the boards of the end cap assembly can comprise wood, low density polyethylene, high density polyethylene, copolymers of low density of polyethylene, other plastic material, natural rubber, synthetic rubber, styrene butadiene resin or blends, or combinations thereof.

In an embodiment, the boards can comprise blends of polyethylene and rubber.

In an embodiment, the layers of each end cap assembly can each comprise a different material with different physical properties, including different durometers and different brittleness.

In an embodiment, the top layer can be a low density polyethylene, the middle layer can be low density polyethylene, and the bottom layer can be wood. This assembly can provide improved rigidity of the end cap assembly.

In an embodiment, the boards can be made from 50 weight percent to 85 weight percent low density polyethylene; 1 weight percent to 5 weight percent filler; and 0.1 weight percent to 0.5 weight percent ultraviolet stabilizers.

In embodiments, 5 weight percent to 35 weight percent high density recycled polyethylene can be added to the formation for the boards of the end cap assembly.

In embodiments, 1 weight percent to 8 weight percent antistatic carbon black can be added to the formation of the boards of the end cap assembly.

In an embodiment, the formulation for the end cap assembly can be formed from at least one of the following: 1 weight percent to 3.5 weight percent styrene butadiene resin; 0.5 weight percent to 1 weight percent sodium bicarbonate; 0.5 weight percent to 3.5 weight percent ethyl vinyl acetate; 1.5 weight percent to 3.5 weight percent polyamide; and 1 weight percent to 10 weight percent polyester.

Embodiments of the formulation used for each board can include 0.5 weight percent to 2 weight percent pigment, such as yellow or black pigment.

The end cap assembly can have yellow pigment added to top layer boards and black pigment added to top layer boards and then assembling the top layer boards in an alternating color pattern.

Blends of polyesters and nylons can be used which melt at a different temperature to create a stringiness or to increase tensile strength.

An embodiment of the end cap assembly for interlocking with an oil field mat having an elongated base layer can be constructed from an elongated base layer with a top side and a bottom side, and a base layer coupler fastened to the top side on an end, the elongated base layer comprising a plurality of base layer boards, all the base layer boards having a longitudinal axis in a first direction.

The end cap assembly with elongated base layer can have a base layer coupler formed on the elongated base layer.

The base layer coupler can have corner locking boards, wherein the corner locking boards are flush with a side edge of the elongated base layer and positioned at each corner of the side, the corner locking boards mounted across at least one of the base layer boards.

The base layer coupler can have a pair of interior long locking boards positioned a board width away from the side and between the corner locking boards.

The base layer coupler can have an exterior locking board between each pair of interior long locking boards, the exterior locking board flush with the side, and the plurality of corner locking boards, interior locking boards and exterior locking board configured in a staggered pattern, each locking board mounted across a plurality of base layer boards.

The end cap assembly can have a top layer comprising a plurality of top layer boards, each top layer board having a longitudinal axis in the first direction.

The end cap assembly with elongated base layer can have a middle layer comprising a plurality of middle boards, each middle board having a longitudinal axis in a second direction that is 90 degrees from the first direction, with the middle layer disposed between the base layer and the top layer.

The end cap assembly can have a plurality of holes formed through each board of each layer, wherein the top layer holes align with the middle layer holes and with the base layer holes.

The end cap assembly can use a plurality of multilayer fasteners, each multilayer fastener disposed in aligned holes of the top, middle and base layers.

The end cap assembly can use a plurality of coupler fasteners, each coupler fastener can be disposed through holes in boards and used to form the base layer coupler.

For the end cap assembly, the boards being used can have at least one of: a square edge board and a beveled board.

For the end cap assembly, each board of the top layer of the end cap can have a groove centrally disposed on the top side of the plurality top layer boards.

For the end cap assembly, in embodiments, the boards of each layer can be mounted in parallel.

The invention can include the end cap assembly for interlocking with an oil field mat with an elongated top layer. Embodiments of the end cap assembly can include an elongated top layer with a top side and a bottom side. The elongated top layer can have a plurality of top layer boards, all the top layer boards having a longitudinal axis in a first direction.

The end cap assembly with elongated top layer can have on the top layer, a top layer coupler formed on the bottom side of the elongated top layer. The top layer coupler can have corner locking boards. The corner locking boards can be flush with a first side of the elongated top layer and positioned at each corner of the first side, with the corner locking boards mounted across a plurality of top layer boards. The top layer coupler can have a pair of interior long locking boards positioned a board width away from the side. The top layer coupler can have an exterior locking board positioned between each pair of interior long locking boards. The exterior locking board can be flush with the side. The plurality of long locking boards can be configured in a staggered pattern; and mounted across a plurality of top layer boards.

The end cap assembly with elongated top layer can have a base layer with a plurality of base layer boards having a longitudinal axis in the first direction.

The end cap assembly with elongated top layer can have a middle layer with a plurality of middle boards. Each middle layer board can have a longitudinal axis in a second direction that is 90 degrees from the first direction, with the middle layer disposed between the base layer and the top layer.

Figure 9:
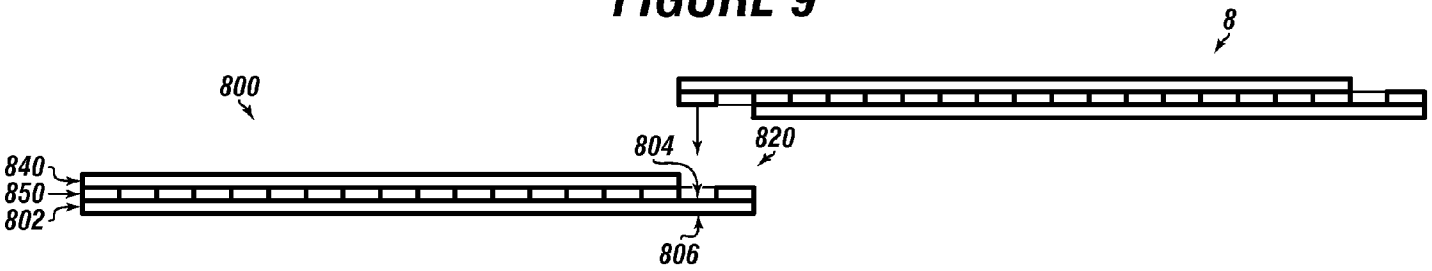
FIG. 9 shows a side view of an end cap assembly for interlocking with an oil field mat having an elongated base layer.

FIG. 9 shows a side view of an end cap assembly 800 for interlocking with an oil field mat 8 having an elongated base layer.

The end cap assembly 800 can have a top layer 840 constructed from a plurality of top layer boards. Each top layer board can have a longitudinal axis in the first direction.

The end cap assembly can have a middle layer 850 formed from a plurality of middle boards. Each middle board can have a longitudinal axis in a second direction that is 90 degrees from the first direction. The middle layer 850 can be disposed between the elongated base layer 802 and the top layer 840.

The elongated base layer 802 can have a top side 804 and a bottom side 806. A base layer coupler 820 can be fastened to the top side 804. The elongated base layer 802 can be formed from a plurality of base layer boards, all the base layer boards having a longitudinal axis in a first direction.

Figure 10:
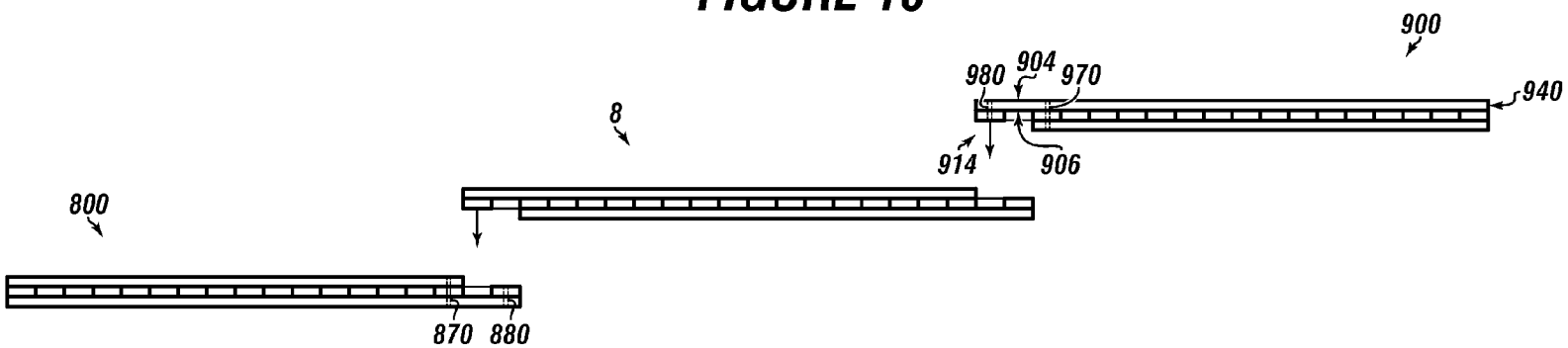
FIG. 10 shows a side view of two different end cap assemblies for interlocking with an oil field mat.

FIG. 10 shows a side view of two different end cap assemblies for interlocking with an oil field mat 8.

End cap assembly 800 is shown with an elongated base layer.

End cap assembly 900 is shown with an elongated top layer 940. The elongated top layer 940 can have a top side 904 and a bottom side 906.

The elongated top layer 940 can be formed from a plurality of top layer boards. All the top layer boards can be configured to have a longitudinal axis in a first direction.

A top layer coupler 914 can be formed on the bottom side 906 of the elongated top layer 940.

The end cap assembly with elongated top layer can have a plurality of holes formed through each board of each layer, wherein the top layer holes align with the middle layer holes and with the base layer holes.

The end cap assembly with elongated top layer can use a plurality of multilayer fasteners. Multilayer fastener 970 is shown. Each multilayer fastener can be disposed in aligned holes of the top, middle and base layers.

The end cap assembly with elongated top layer can use a plurality of coupler fasteners. Coupler fastener 980 is shown. Each coupler fastener can be disposed through holes in boards used to form the base layer coupler.

The end cap assembly with elongated bottom layer can have a plurality of multilayer fasteners used to connect the top layer board through the middle layer boards to the base layer boards. Each multilayer fastener can be disposed in aligned holes of the top, middle and base layers. Multilayer fastener 870 is shown. One of a plurality of coupler fasteners 880 is also shown. Each coupler fastener can be disposed through holes in the boards used to form the base layer coupler.

Figure 11A:
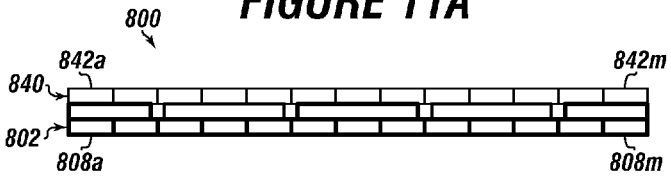
FIG. 11A shows an end view of the end cap assembly with an elongated base layer.

FIG. 11A shows an end view of the end cap assembly 800 with an elongated base layer.

A top layer 840 can be made from a plurality of top layer boards 842*a*-842*m*. Each top layer board can have a longitudinal axis in the first direction The elongated base layer 802 can be formed from a plurality of base layer boards 808*a*-808*m*. All the base layer boards can have a longitudinal axis in the same direction as the top layer boards, that is, a first direction.

Figure 11B:
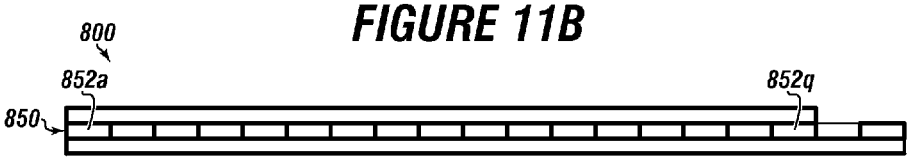
FIG. 11B shows a side view of the end cap assembly having an elongated base layer.

FIG. 11B shows a side view of the end cap assembly 800 having an elongated base layer.

A middle layer 850 can be formed from a plurality of middle boards 852*a*-852*q*.

Figure 11C:
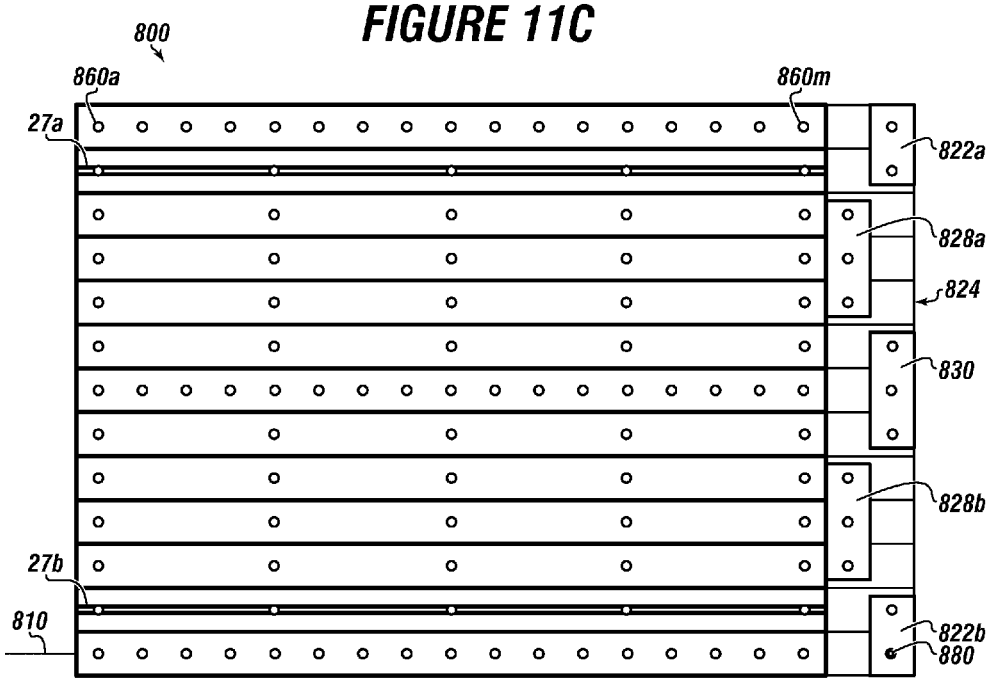
FIG. 11C shows a top view of the end cap assembly having an elongated base layer.

FIG. 11C shows a top view of the end cap assembly 800 having an elongated base layer.

A plurality of holes 860*a*-860*m* can be formed through each board of each layer. The top layer holes can align with the middle layer holes and with the base layer holes.

Each board of the top layer can have a groove 27*a* centrally disposed on the top side of the plurality top layer boards. Groove 27*b* is also shown.

A base layer coupler can be formed on the elongated base layer.

The base layer coupler can have corner locking boards 822*a* and 822*b*. The corner locking boards 822*a* and 822*b* can be flush with a side edge 824 of the elongated base layer and positioned at each corner of the side edge 824.

The corner locking boards 822*a* and 822*b* can be mounted across at least one of the base layer boards.

A pair of interior long locking boards 828*a* and 828*b* are positioned a board's width away from the side 824 and between the corner locking boards.

An exterior locking board 830 can be positioned between each pair of interior long locking boards 828*a* and 828*b*.

The exterior locking board can be flush with the side 824.

The plurality of corner locking boards, interior locking boards and exterior locking board can be configured in a staggered pattern, each locking board mounted across a plurality of base layer boards.

The plurality of base layer boards can have a longitudinal axis 810 in a first direction.

One of the plurality of coupler fasteners 880 is shown. Each coupler fastener can be disposed through holes in boards used to form the base layer coupler.

Figure 12A:
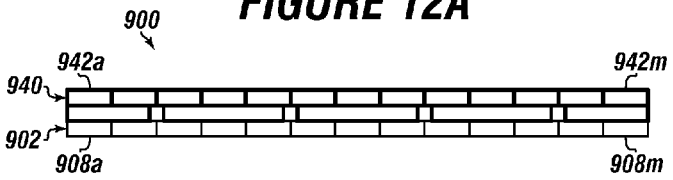
FIG. 12A shows an end view of the end cap assembly with elongated top layer.

FIG. 12A shows an end view of the end cap assembly 900 with elongated top layer.

The end cap assembly 900 can have an elongated top layer 940 made from a plurality of top layer boards 942*a*-942*m*. Each top layer board having a longitudinal axis in the first direction The base layer 902 can be formed from a plurality of base layer boards 908*a*-908*m*. The plurality of base layer boards can have a longitudinal axis in the same direction as the top layer boards, that is, a first direction.

Figure 12B:
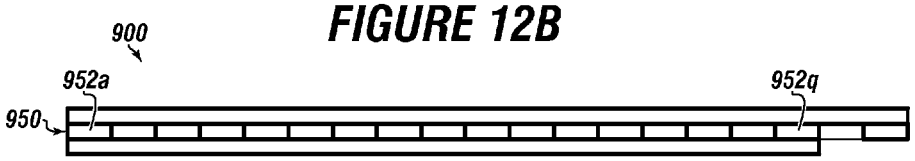
FIG. 12B is a side view of the end cap assembly with elongated top layer.

FIG. 12B is a side view of the end cap assembly 900 with elongated top layer. A middle layer 950 can be formed from a plurality of middle boards 952*a*-952*q*.

Figure 12C:
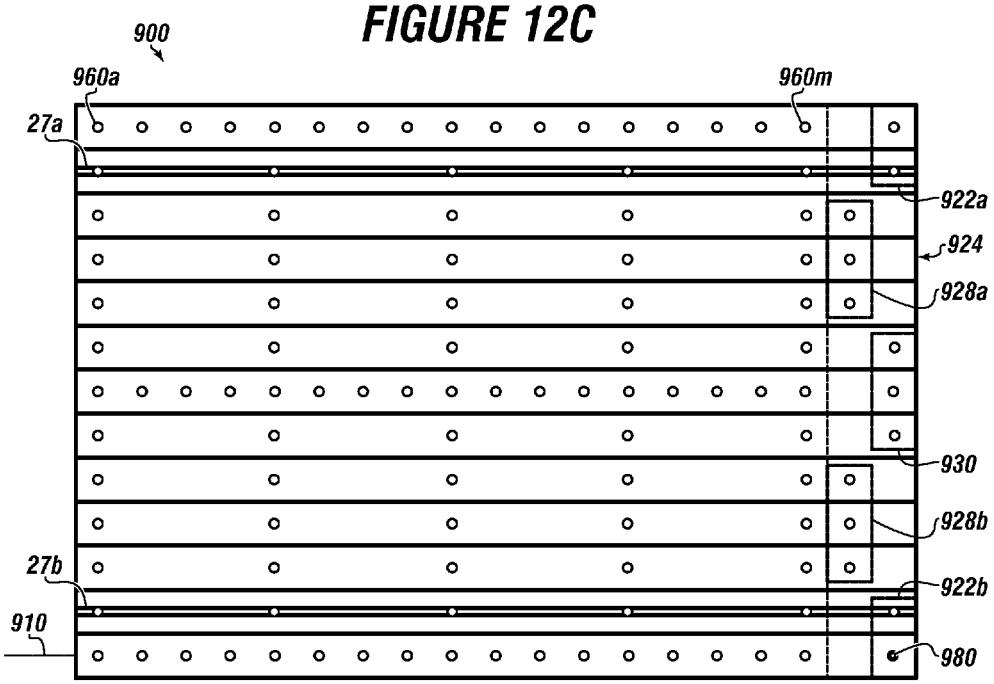
FIG. 12C shows a top view of the end cap assembly having an elongated top layer.

FIG. 12C shows a top view of the end cap assembly 900 having an elongated top layer.

A plurality of holes 960*a*-960*m* can be formed through each board of each layer. The top layer holes can align with the middle layer holes and with the base layer holes.

Each board of the top layer can have a groove 27*a* centrally disposed on the top side of the plurality top layer boards. Groove 27*b* is also shown.

A top layer coupler can be formed on the elongated top layer.

The top layer coupler can have corner locking boards 922*a* and 922*b*. The corner locking boards 922*a* and 922*b* can be flush with a side edge 924 of the elongated top layer and positioned at each corner of the side edge 924.

The corner locking boards 922*a* and 922*b* can be mounted across at least one of the top layer boards.

A pair of interior long locking boards 928*a* and 928*b* can be positioned a board's width away from the side 924 and between the corner locking boards.

An exterior locking board 930 can be positioned between each pair of interior long locking boards 928*a* and 928*b*. The exterior locking board can be flush with the side 924.

The plurality of corner locking boards, interior locking boards and exterior locking board can be configured in a staggered pattern, each locking board mounted across a plurality of top layer boards.

The plurality of top layer boards can have a longitudinal axis 910 in a first direction.

Figure 13:
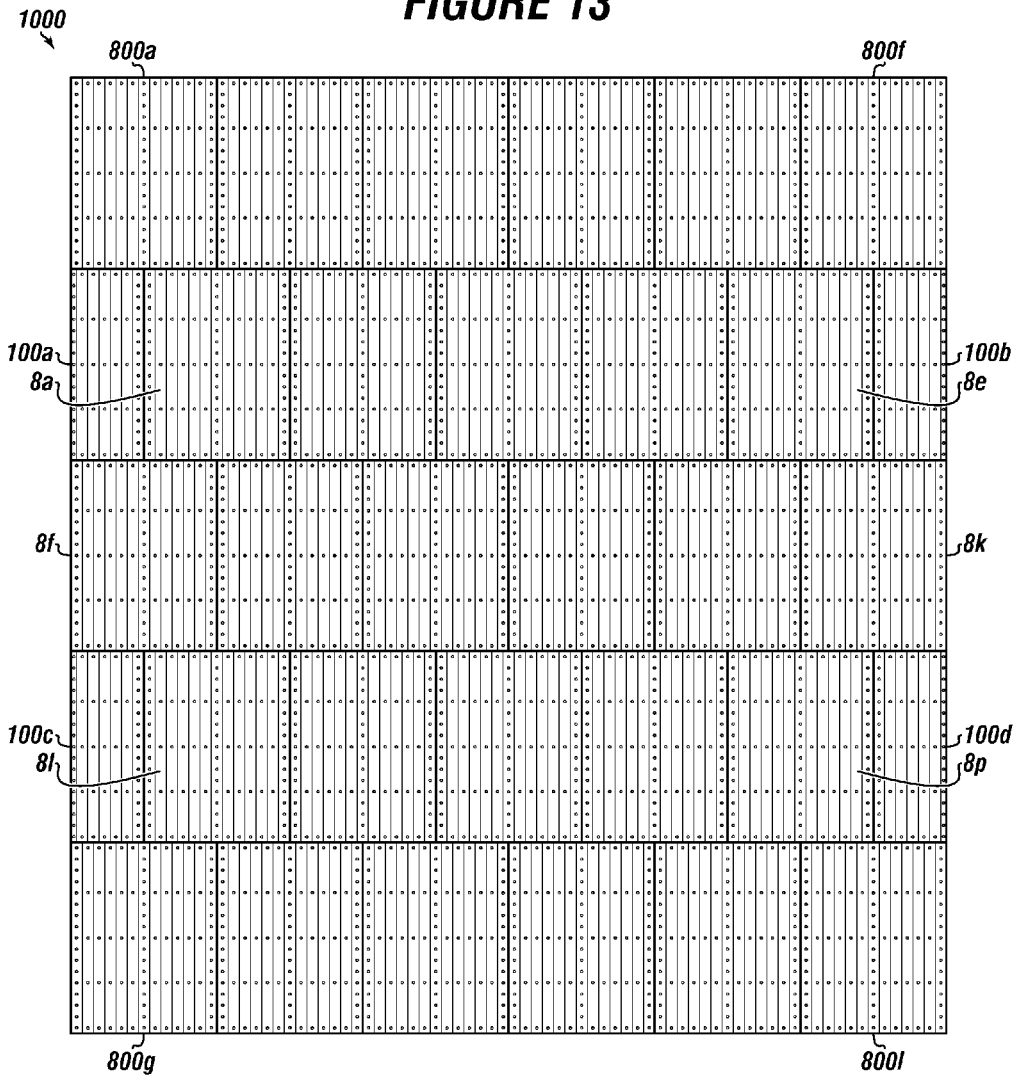
FIG. 13 shows a diagram of an oil field mat assembly.

One of the plurality of coupler fasteners 980 is shown. Each coupler fastener can be disposed through holes in boards used to form the base layer coupler FIG. 13 shows a diagram of an oil field mat assembly.

The oil field mat assembly 1000 can have three layers. Sixteen (16) oil field mats 8*a*-8*p* are shown connected to twelve (12) end cap assemblies 800*a*-8001, one end cap assembly connected to each oil field mat. Four half mats 100*a*-100*d* are shown, each half mat connected to an oil field mat.

Figure 14:
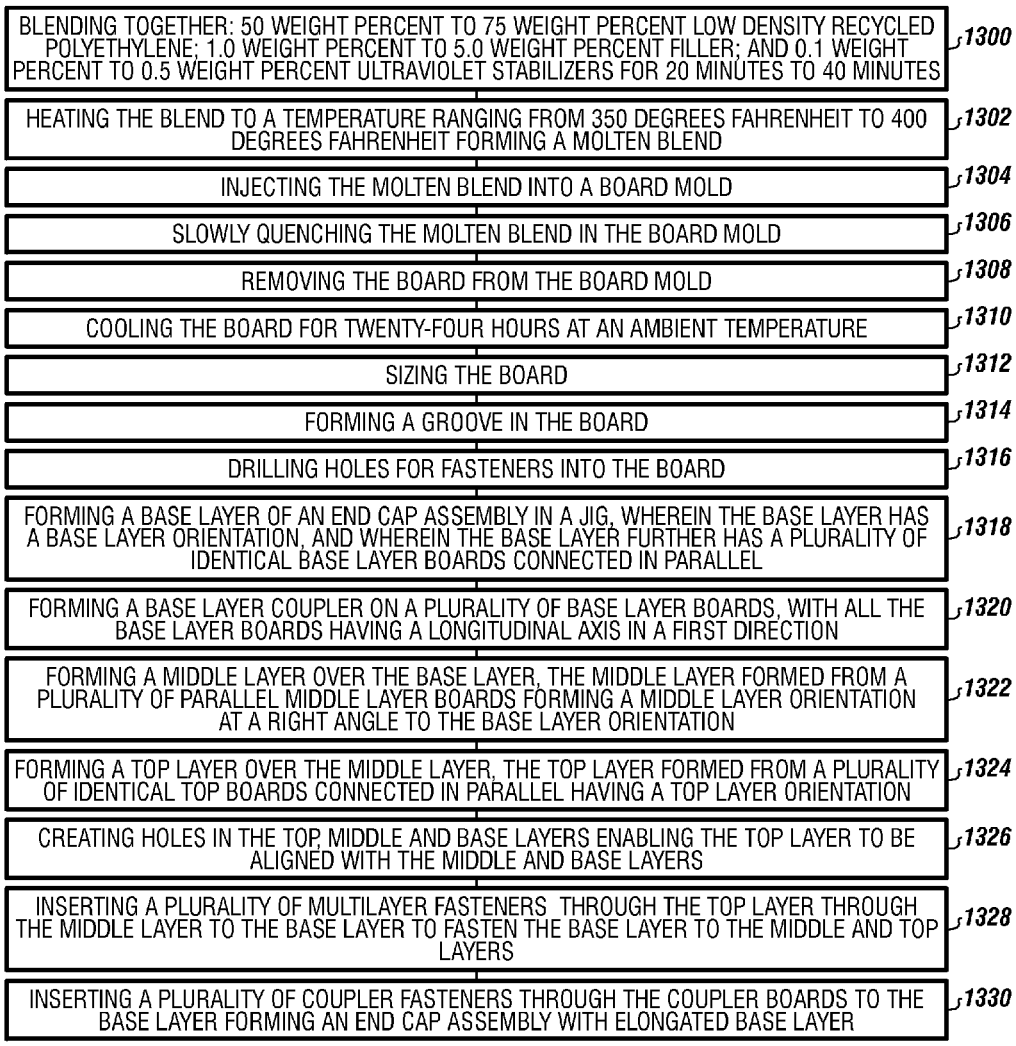
FIG. 14 depicts a method for making an end cap assembly.

FIG. 14 depicts a method for making an end cap assembly.

The method can include blending together: 50 weight percent to 75 weight percent low density recycled polyethylene; 1.0 weight percent to 5.0 weight percent filler; and 0.1 weight percent to 0.5 weight percent ultraviolet stabilizers from 20 minutes to 40 minutes, as shown in step 1300.

The method can include heating the blend to a temperature ranging from 350 degrees Fahrenheit to 400 degrees Fahrenheit forming a molten blend, as shown in step 1302.

The method can include injecting the molten blend into a board mold, as shown in step 1304.

The method can include slowly quenching the molten blend in the board mold, as shown in step 1306.

The method can include removing the board from the board mold, as shown in step 1308.

The method can include cooling the board for twenty-four hours at an ambient temperature, as shown in step 1310.

The method can include sizing the board, as shown in step 1312.

The method can include forming a groove in the board, as shown in step 1314.

The method can include drilling holes for fasteners into the board, as shown in step 1316.

The method can include forming a base layer of an end cap assembly in a jig, wherein the base layer has a base layer orientation, and wherein the base layer further has a plurality of identical base layer boards connected in parallel, as shown in step 1318.

The method can include forming a base layer coupler on a plurality of base layer boards, with all the base layer boards having a longitudinal axis in a first direction, as shown in step 1320.

In this method, the base layer coupler can have corner locking boards.

The corner locking boards can be flush with a side edge of the base layer and positioned at each corner of the side edge and the corner locking boards mounted across a plurality of base layer boards.

The base layer coupler can have a plurality of long locking boards positioned between the corner locking boards.

The long locking boards can have at least a pair of interior long locking boards positioned a board width away from the side, and an exterior locking board between each pair of interior long locking boards.

The base layer coupler can have an exterior locking board flush with the side.

The base layer coupler can have the plurality of long locking boards configured in a staggered pattern and mounted across a plurality of base layer boards.

The method can include forming a middle layer over the base layer, the middle layer formed from a plurality of parallel middle layer boards forming a middle layer orientation at a right angle to the base layer orientation, as shown in step 1322.

The method can include forming a top layer over the middle layer, the top layer formed from a plurality of identical top boards connected in parallel having a top layer orientation, as shown in step 1324. The top layer orientation being identical to the bottom layer orientation.

The method can include creating holes in the top, middle and base layers enabling the top layer to be aligned with the middle and base layers, as shown in step 1326.

The method can include inserting a plurality of multilayer fasteners through the top layer through the middle layer to the base layer to fasten the base layer to the middle and top layers, as shown in step 1328.

The method can include inserting a plurality of coupler fasteners through the coupler boards to the base layer forming an end cap assembly with elongated base layer, as shown in step 1330.

In embodiments, the invention can include a three layer oil field mat assembly has an oil field mat with having an end cap assembly with elongated base layer. In embodiments, the invention can include a three layer oil field mat assembly comprising an oil field mat with having an end cap assembly with elongated top layer.

While these embodiments have been described with emphasis on the embodiments, it should be understood that within the scope of the appended claims, the embodiments might be practiced other than as specifically described herein.

What is claimed is:

1. An end cap assembly for interlocking with an oil field mat, comprising (a) an elongated base layer with a top side and a bottom side, and a base layer coupler fastened to the top side on an end, the elongated base layer comprising a plurality of base layer boards, the plurality of base layer boards having a longitudinal axis in a first direction, wherein the based layer coupler comprises:

(i) corner locking boards, wherein the corner locking boards are flush with a side edge of the elongated base layer and positioned at each corner of the side edge, the corner locking boards mounted across at least one of the base layer boards;

(ii) a pair of interior long locking boards positioned an interior long locking board width away from the side edge and between the corner locking boards; and (iii) an exterior locking board between the pair of interior long locking boards, the exterior locking board flush with the side edge, and interior locking boards and exterior locking board configured in a staggered pattern, each locking board mounted across a plurality of base layer boards;

(b) a top layer comprising a plurality of top layer boards, each top layer board having a longitudinal axis in the first direction; and (c) a middle layer comprising a plurality of middle boards, each middle board having a longitudinal axis in a second direction that is 90 degrees from the first direction, with the middle layer disposed between the elongated base layer and the top layer;

(d) a plurality of holes formed through each board of each layer, wherein the top layer holes align with the middle layer holes and with the base layer holes;

(e) a plurality of multilayer fasteners, each multilayer fastener disposed in aligned holes of the top, middle and base layers; and (f) a plurality of coupler fasteners, each coupler fastener disposed through holes in boards used to form the base layer coupler.

2. The end cap assembly of claim 1, wherein the boards are a square edge board, a beveled board, or combinations thereof.

3. The end cap assembly of claim 1, wherein each board of the top layer has a groove centrally disposed on the top side of the plurality top layer boards.

4. The end cap assembly of claim 1, wherein the boards of each layer are mounted in parallel.

5. The end cap assembly of claim 1, wherein each of the boards of the end cap assembly is comprised of a formulation of:

(a) 50 weight percent to 85 weight percent low density recycled polyethylene;

(b) 1 weight percent to 5 weight percent filler; and (c) 0.1 weight percent to 0.5 weight percent ultraviolet stabilizers.

6. The end cap assembly of claim 5, comprising 1 weight percent to 8 weight percent antistatic carbon black.

7. The end cap assembly of claim 5, comprising 5 weight percent to 35 weight percent high density recycled polyethylene.

8. The end cap assembly cap of claim 5, comprising at least one of:

(a) 1.0 weight percent to 3.5 weight percent styrene butadiene resin;

(b) 0.5 weight percent to 1.0 weight percent sodium bicarbonate;

(c) 0.5 weight percent to 3.5 weight percent ethyl vinyl acetate;

(d) 1.5 weight percent to 3.5 weight percent polyamide;

(e) 1.0 weight percent to 10 weight percent polyester; and (f) 0.5 weight percent to 2 weight percent pigment.

9. The end cap assembly of claim 1, wherein the top layer, middle layer, and elongated base layer are connected to each other by a plurality of fasteners comprising a screw, a bolt, a nail, an epoxy, or combination thereof.

10. The end cap assembly of claim 1, wherein each of the boards comprise at least one of: wood, low density polyethylene, high polyethylene, copolymers of low density polyethylene, other plastic material, natural rubber, synthetic rubber, and styrene butadiene resin.

11. The end cap assembly of claim 1, wherein each of the boards consists of blends of polyethylene and rubber.

12. The end cap assembly of claim 1, wherein each layer of the end cap assembly comprises a different material with different physical properties, including different durometers and different brittleness.

13. The end cap assembly of claim 1, comprising yellow pigment added to top layer boards and black pigment added to top layer boards and then assembling the top layer boards in an alternating color pattern.

14. An end cap assembly for interlocking with an oil field mat, comprising (a) an elongated top layer with a top side and a bottom side, the elongated top layer comprising: a plurality of top layer boards, all the top layer boards having a longitudinal axis in a first direction;

(b) a top layer coupler formed on the bottom side of the elongated top layer comprising:

(i) corner locking boards, wherein the corner locking boards are flush with a first side of the elongated top layer and positioned at each corner of the first side, with the corner locking boards mounted across a plurality of top layer boards;

(ii) a pair of interior long locking boards positioned an interior long locking board's width away from the side edge, and (iii) an exterior locking board positioned between the pair of interior long locking boards, the exterior locking board flush with the side edge, the plurality of long locking boards configured in a staggered pattern; and mounted across a plurality of top layer boards;

(c) a base layer comprising a plurality of base layer boards, each base layer board having a longitudinal axis in the first direction; and (d) a middle layer comprising: a plurality of middle boards, each middle layer board having a longitudinal axis in a second direction that is 90 degrees from the first direction, with the middle layer disposed between the base layer and the top layer;

(e) a plurality of holes formed through each board of each layer, wherein the top layer holes align with the middle layer holes and with the base layer holes;

(f) a plurality of multilayer fasteners, each multilayer fastener disposed in aligned holes of the top, middle and base layers; and (g) a plurality of coupler fasteners, each coupler fastener disposed through holes in boards used to form a top layer coupler.

15. The end cap assembly of claim 14, wherein boards are a square edge board, a beveled board, or combinations thereof.

16. The end cap assembly of claim 14, wherein each board of the top layer of the end cap assembly has a groove centrally disposed on the top side of the plurality top layer boards.

17. The end cap assembly of claim 14, wherein the boards of each layer are mounted in parallel.

18. The end cap assembly of claim 14, wherein each of the boards of the end cap assembly is comprised of a formulation of:

(a) 50 weight percent to 85 weight percent low density recycled polyethylene;

(b) 1 weight percent to 5 weight percent filler; and (c) 0.1 weight percent to 0.5 weight percent ultraviolet stabilizers.

19. The end cap assembly of claim 18, comprising 1 weight percent to 8 weight percent antistatic carbon black.

20. The end cap assembly of claim 18, comprising 5 weight percent to 35 weight percent high density recycled polyethylene.

21. The end cap assembly cap of claim 18, comprising at least one of:

(a) 1 weight percent to 3.5 weight percent styrene butadiene resin;

(b) 0.5 weight percent to 1 weight percent sodium bicarbonate;

(c) 0.5 weight percent to 3.5 weight percent ethyl vinyl acetate;

(d) 1.5 weight percent to 3.5 weight percent polyamide;

(e) 1 weight percent to 10 weight percent polyester; and (f) 0.5 weight percent to 2 weight percent pigment.

22. The end cap assembly of claim 14, wherein the elongated top layer, middle layer, and base layer are connected to each other by a plurality of fasteners comprising a screw, a bolt, a nail, or an epoxy.

23. The end cap assembly of claim 14, wherein each of the boards comprise at least one of: wood, low density polyethylene, high polyethylene, copolymers of low density of polyethylene, other plastic material, natural rubber, synthetic rubber, and styrene butadiene resin.

24. The end cap assembly of claim 14, wherein each of the boards consists of blends of polyethylene and rubber.

25. The end cap assembly of claim 14, wherein each layer of the end cap assembly comprises a different material with different physical properties, including different durometers and different brittleness.

26. The end cap assembly of claim 14, comprising yellow pigment added to top layer boards and black pigment added to top layer boards and then assembling the top layer boards in an alternating color pattern.

* * * * *